US007554567B2

(12) United States Patent
Nakanishi

(10) Patent No.: US 7,554,567 B2
(45) Date of Patent: Jun. 30, 2009

(54) THERMAL PRINTHEAD

(75) Inventor: Masatoshi Nakanishi, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 290 days.

(21) Appl. No.: 10/587,116

(22) PCT Filed: Jan. 21, 2005

(86) PCT No.: PCT/JP2005/000757

§ 371 (c)(1),
(2), (4) Date: Jul. 24, 2006

(87) PCT Pub. No.: WO2005/070682

PCT Pub. Date: Aug. 4, 2005

(65) Prior Publication Data

US 2008/0239058 A1 Oct. 2, 2008

(30) Foreign Application Priority Data

Jan. 26, 2004 (JP) ..... 2004-016706

(51) Int. Cl.
*B41J 2/335* (2006.01)

(52) U.S. Cl. ..... 347/200

(58) Field of Classification Search ..... 347/200, 347/201, 202, 203, 204, 205, 206, 208
See application file for complete search history.

(56) References Cited

FOREIGN PATENT DOCUMENTS

| | | |
|---|---|---|
| JP | 5-169698 | 7/1993 |
| JP | 7-132630 | 5/1995 |
| JP | 10-100460 | 4/1998 |
| JP | 11-157111 | 6/1999 |

*Primary Examiner*—K. Feggins
(74) *Attorney, Agent, or Firm*—Hamre, Schumann, Mueller & Larson, P.C.

(57) ABSTRACT

A thermal printhead (A1) includes a substrate (1) and a plurality of heat-producing resistance sections (30) provided on the substrate (1). The heat-producing resistance sections (30) melt ink of an ink ribbon, which is transferred together with a recording sheet, to transfer the ink onto the recording sheet. An inequality surface region (7) is provided downstream from the heat-producing resistance sections (30) in a secondary scanning direction (x) which is the transfer direction of the ink ribbon. The inequality surface region includes a plurality of projections (70) each of which extends in the secondary scanning direction (x) and which are aligned at predetermined intervals in a primary scanning direction (y) which is perpendicular to the secondary scanning direction (x).

5 Claims, 6 Drawing Sheets

THERMAL PRINTHEAD

TECHNICAL FIELD

The present invention relates to a thermal printhead suitable for printing using a thermal ink ribbon.

BACKGROUND ART

FIG. 5 shows an example of a thermal printhead as related art. The illustrated thermal printhead B includes an insulating substrate 90 on which a glaze layer 91, a resistor layer 92, an electrode layer 93 and a protective layer 94 are successively formed.

The electrode layer 93 includes a plurality of electrode portions 93*a* and a plurality of electrode portions 93*b* which are spaced from each other to provide a gap therebetween where the electrode layer does not overlap the resistor layer 92. Of the resistor layer 92, the portion corresponding to the gap between the electrode portions 93*a* and the electrode portion 93*b* serves as a heat-producing resistance section 92*a* which is heated when energized. The heat-producing resistance section 92*a* is located on a bulging portion 91*a* of the glaze layer 91 against which a recording sheet S and an ink ribbon R are pressed by a platen roller P. This arrangement enhances the contact pressure between the recording sheet S, the ink ribbon R and the heat-producing resistance section 92*a*.

The platen roller P is made of rubber, for example. Two strips of edge patterns 95 are provided downstream from the electrode portions 93*b* of the electrode layer 93 in a secondary scanning direction x which is the transfer direction of the recording sheet S and the ink ribbon R. The edge patterns 95 serve to prevent the glaze layer 91 from chipping at the edge thereof or the nearby portions during the manufacturing process of the thermal printhead B or the subsequent handling.

Patent Document 1: JP-A-H05-169698

The thermal printhead B has the following drawbacks.

As indicated by the arrows in FIG. 5, in performing printing on the recording sheet S, the recording sheet S and the ink ribbon R are transferred in the secondary scanning direction x while being pressed against the heat-producing resistance section 92*a* or the nearby portions by the platen roller P. The ink ribbon R has a relatively small thickness and is likely to be wrinkled. Therefore, when the ink ribbon R is transferred while being pressed against the thermal printhead B, wrinkles may be formed in the ink ribbon R.

Particularly, of the ink ribbon R, the portion heated by the heat-producing resistance section 92*a* expands and then shrinks due to the cooling by air. The shrinkage occurs also in the width direction of the ink ribbon R, which encourages the formation of wrinkles in the ink ribbon R.

Moreover, since the region where two edge patterns 95 are provided is bulged in the thermal printhead B, the ink ribbon R is pressed also against this portion strongly. Also for this reason, a force corresponding to the transferring force of the platen roller P is exerted on the ink ribbon R in the direction opposite from the secondary scanning direction x, which may result in the formation of wrinkles in the ink ribbon R. When the ink ribbon R is wrinkled and hence folded, ink cannot be properly transferred from the folded portion of the ink ribbon R to the recording sheet S, which results in print failure.

DISCLOSURE OF THE INVENTION

An object of the present invention, which is conceived under the above-described circumstances, is to provide a thermal printhead which is capable of preventing wrinkles from being formed in an ink ribbon and hence preventing the print failure caused by such wrinkles in the ink ribbon.

According to a first aspect of the present invention, there is provided a thermal printhead comprising a substrate and a plurality of heat-producing resistance sections provided on the substrate. The heat-producing resistance sections melt ink of an ink ribbon, which is transferred together with a recording sheet, to transfer the ink onto the recording sheet. The thermal printhead further comprises an inequality surface region provided downstream from the heat-producing resistance sections in a secondary scanning direction which is the transfer direction of the ink ribbon. The inequality surface region includes a plurality of projections each of which extends in the secondary scanning direction and which are aligned at predetermined intervals in a primary scanning direction which is perpendicular to the secondary scanning direction.

Preferably, at least some of the projections are inclined with respect to a center line so as to become farther from the center line as the projections extend downstream in the secondary scanning direction. The center line is a line positioned at the center, in the primary scanning direction, of a region where the heat-producing resisting sections are arranged.

Preferably, the thermal printhead further comprises a glaze layer formed on the substrate, and an edge pattern which is formed adjacent to a downstream edge of the glaze layer in the secondary scanning direction and is in a form of a rib extending in the primary scanning direction. The inequality surface region is provided by forming inequalities at an upper portion of the edge pattern.

According to a second aspect of the present invention, there is provided a thermal printhead comprising a substrate, a glaze layer provided on the substrate, a plurality of heat-producing resistance sections provided on the glaze layer, an electrode layer connected to the heat-producing resistance sections, and a protective layer covering the heat-producing resistance sections and the electrode layer. The heat-producing resistance sections melt ink of an ink ribbon, which is transferred together with a recording sheet, to transfer the ink onto the recording sheet. The electrode layer includes an electrode portion located downstream from the heat-producing resistance sections in a secondary scanning direction which is the transfer direction of the ink ribbon. Of an obverse surface of the protective layer, a region which is located downstream from the electrode portion in the secondary scanning direction is lower, in height on an obverse surface of the glaze layer, than a region covering the electrode portion and comprises a smooth surface without recesses or projections.

Preferably, of the obverse surface of the protective layer, the region which is located downstream from the electrode portion in the secondary scanning direction is inclined to reduce the height from the substrate as the region extends downstream in the secondary scanning direction.

BEST MODE FOR CARRYING OUT THE INVENTION

Preferred embodiments of the present invention will be described below in detail with reference to the accompanying drawings.

Figure 1:
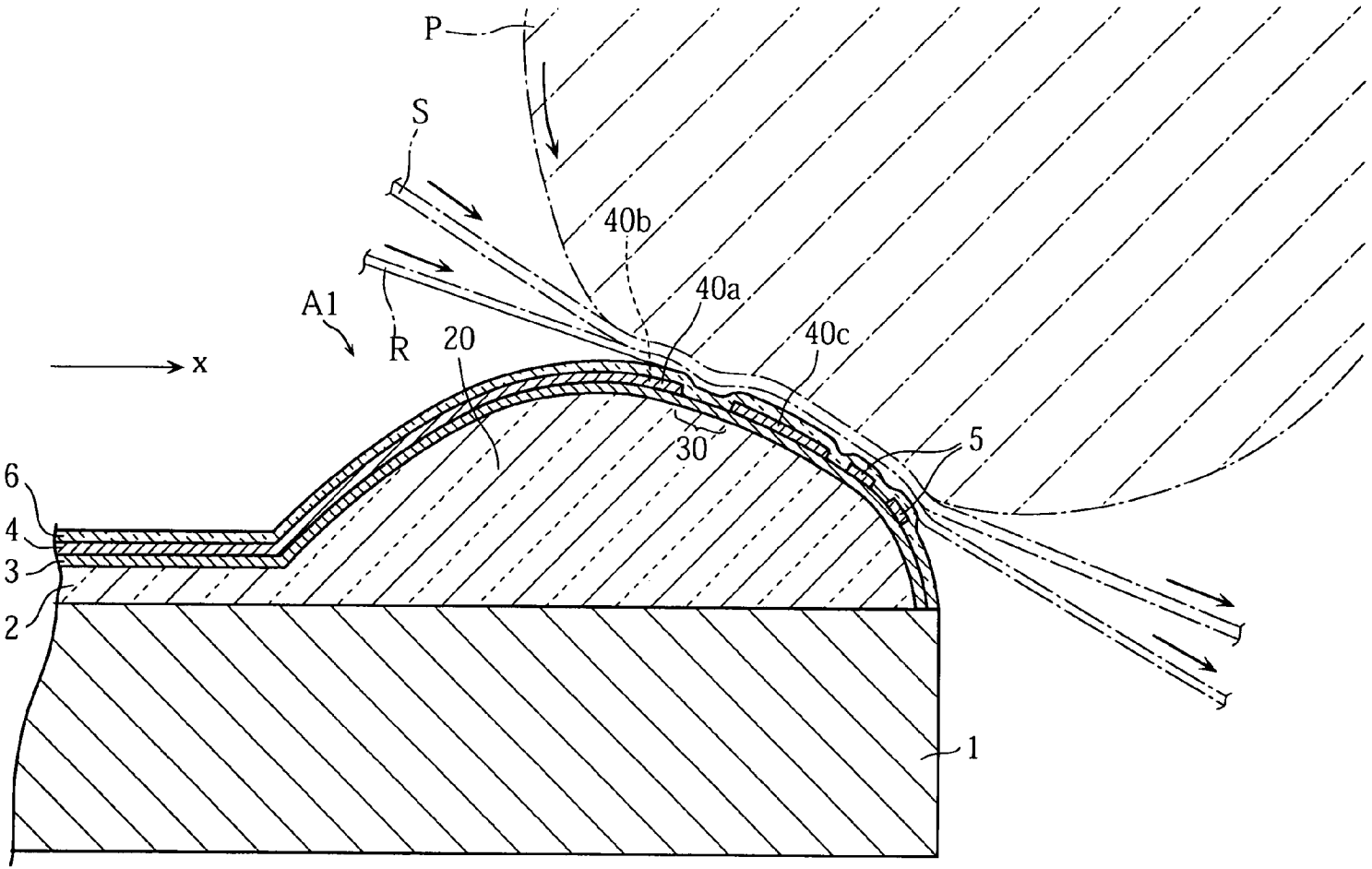
FIG. 1 is a sectional view showing a principal portion of a thermal printhead according to a first embodiment of the present invention.
Figure 2A:
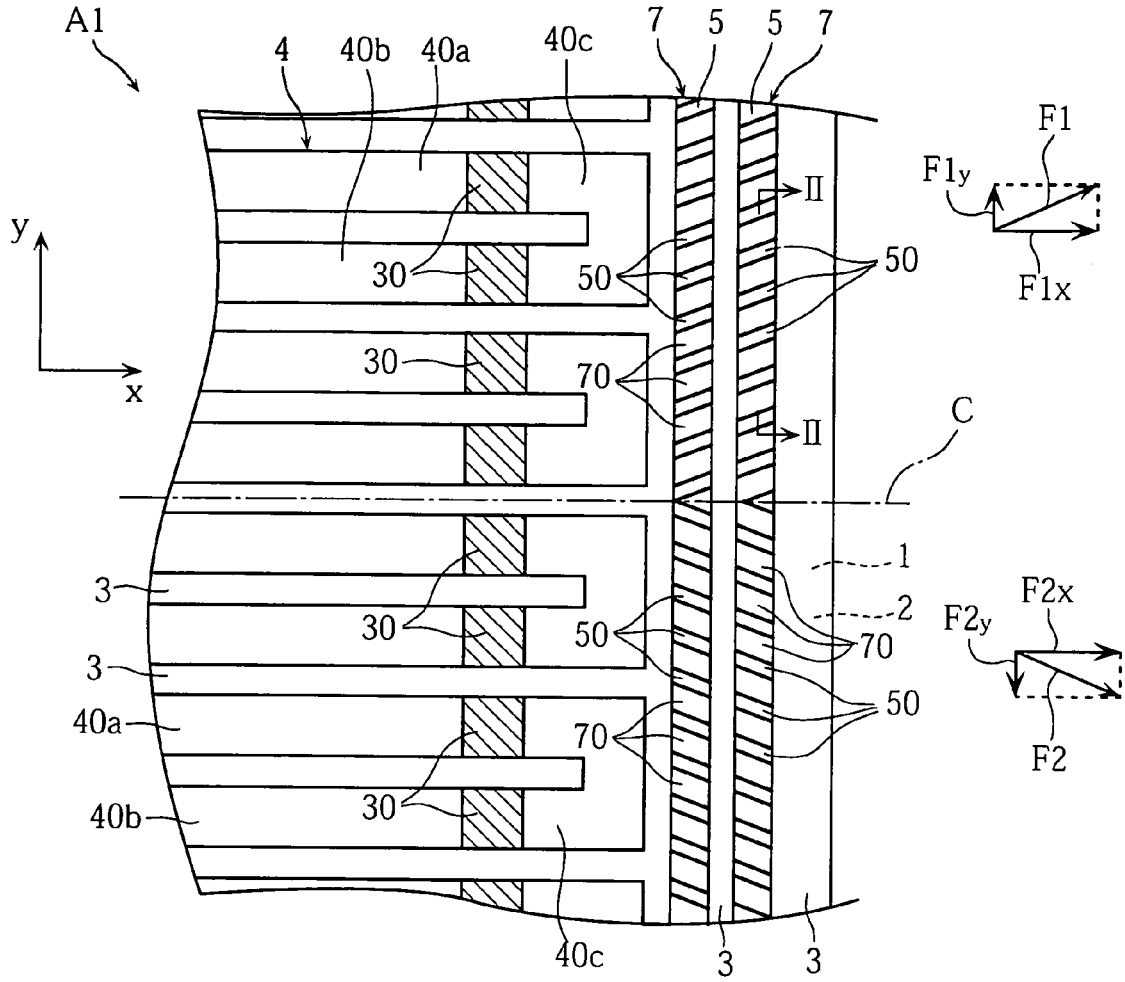
FIG. 2A is an enlarged plan view of the principal portion of the thermal printhead shown in FIG. 1.
Figure 2B:
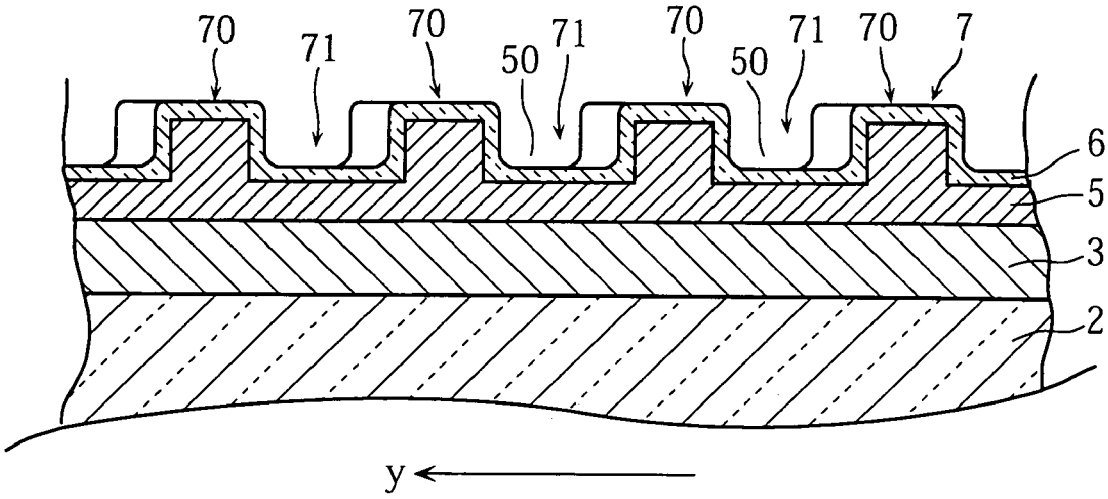
FIG. 2B is a sectional view of the principal portion taken along lines II-II in FIG. 2A.

FIGS. 1, 2A and 2B show a thermal printhead according to a first embodiment of the present invention. In FIG. 2A, the illustration of a protective layer indicated by the reference sign 6 in FIG. 1 is omitted.

As shown in FIG. 1, the thermal printhead A1 according to the first embodiment includes a substrate 1, a glaze layer 2, a resistor layer 3, an electrode layer 4, two strips of edge patterns 5, and a protective layer 6.

The thermal printhead A1 utilizes a platen roller P for printing. Specifically, a recording sheet S and a thermal ink ribbon R are supplied between the platen roller P and the thermal printhead A1, and printing on the recording sheet S is performed while transferring the recording sheet S and the ink ribbon R in a secondary scanning direction x. The surface portion of the platen roller P is made of rubber, for example, so that it deforms upon contact with the thermal printhead A1 due to the contact pressure.

The substrate 1 is a ceramic insulating substrate in the form of a rectangular flat plate elongated in a primary scanning direction y (See FIG. 2A). The glaze layer 2, which is formed by printing and burning glass paste, is laminated on the substrate 1. The glaze layer 2 functions to enhance the heat storage and to smooth the surface on which the resistor layer 3 is to be formed. An edge (right edge in FIG. 2A) of the glaze layer 2 in the secondary scanning direction x is formed with a bulging portion 20 which is bulged to have a convex surface and extends in the primary scanning direction y to have a uniform cross section. The bulging portion 20 serves to increase the contact pressure between the recording sheet S or the rink ribbon R and heat-producing resistance sections 30 which will be described later and enhance the heat storage around the heat-producing resistance sections 30.

The resistor layer 3 may comprise a $TaSi_2$-sputtered film or other metal films and laminated on the glaze layer 2. Part of the resistor layer 3 provides the heat-producing resistance sections 30 which generate heat when energized through the electrode layer 4. As shown in FIG. 2A, the plurality of heat-producing resistance sections 30 are aligned in the primary scanning direction y at predetermined intervals. (In the figure, the heat-producing resistance sections 30 are hatched.)

The electrode layer 4 is made of a metal which is lower in resistivity than the resistor layer 3, such as aluminum or gold, and laminated on the resistor layer 3. The electrode layer 4 includes a plurality of first electrode portions 40*a*, second electrode portions 40*b* and third electrode portions 40*c*. The first and the second electrode portions 40*a*, 40*b* and the third electrode portions 40*c* are spaced from each other so as to interpose the heat-producing resistance sections 30 therebetween in the secondary scanning direction x.

As shown in FIG. 2A, each of the third electrode portions 40*c* is channel-shaped in plan view, located downstream from the heat-producing resistance sections 30 in the secondary scanning direction x, and electrically connects a pair of adjacent heat-producing resistance sections 30 aligned in the primary scanning direction y to each other. The first and the second electrode portions 40*a* and 40*b* are in the form of a strip extending in the secondary scanning direction x and located upstream from the heat-producing resistance sections 30 in the secondary scanning direction x. Each of the first electrode portions and the adjacent one of the second electrode portions are electrically connected to two adjacent heat-producing resistance sections 30, respectively. The first electrode portion 40*a* is electrically connected to a non-illustrated common wiring, whereas the second electrode portion 40*b* is electrically connected to a non-illustrated drive IC. By the switching operation of the drive IC, current supply to the two heat-producing resistance sections 30 is switched on and off.

The protective layer 6 serves to provide insulation and protection for each portion of the thermal printhead A1 and is so formed as to cover the glaze layer 2, the resistor layer 3, the electrode layer 4 and the two strips of edge patterns 5. Similarly to the glaze layer 2, the protective layer 6 is formed by printing and burning glass paste.

The two strips of edge patterns 5 are provided downstream from the third electrode portions 40*c* in the secondary scanning direction x and close to an edge of the protective layer 6. The edge patterns 5 serve to prevent the protective layer 6 from chipping adjacent the edge thereof. The edge patterns 5 are in the form of ribs spaced from each other in the secondary scanning direction x and extending in the primary scanning direction y. For instance, the edge patterns 5 are made of the same material as that of the electrode layer 4 and can be formed at the same time as the electrode layer 4. The thickness of each of the edge patterns 5 is generally equal to that of the electrode layer 4.

As shown in FIG. 2B, each of the edge patterns 5 has an upper portion formed with a plurality of grooves 50 which open upward so that the upper portion of the edge pattern 5 is formed with projections and recesses. Each of the grooves 50 may be made by machining, etching or leaser machining, for example. As shown in FIG. 2B, since the upper portion of each of the edge patterns 5 is formed with projections and recesses, the portion of the protective layer 6 which covers the edge patterns 5 is an inequality surface region 7 conforming to the edge patterns 5.

The inequality surface region 7 includes a plurality of projections 70 and a plurality of grooves 71 arranged alternately in the primary scanning direction y. Each of the projections 70 extends in the secondary scanning direction x. Specifically, except for the projection 70 positioned on the center line C indicated in FIG. 2A, each of the projections 70 is inclined with respect to the center line C so as to become farther from the center line C as it extends downstream in the secondary scanning direction x. The center line C is the line positioned at the center, in the primary scanning direction y, of the region where the heat-producing resistance sections 30 are arranged.

In the thermal printhead Al, the platen roller P transfers the ink ribbon R and the recording sheet S in the secondary scanning direction x while pressing the ink ribbon and the recording sheet against the portion of the protective layer 6 on the heat-producing resistance sections 30 which are selectively heated. In this way, printing on the recording sheet S is performed.

In transferring the ink ribbon R in the secondary scanning direction x in the printing process, part of the ink ribbon is pressed against the inequality surface region 7 by the platen roller P. During this process, a transferring force for transferring the ink ribbon R in the longitudinal direction of the projections 70 is generated between the ink ribbon R and the inequality surface region 7.

Each of the projections 70 is inclined to become farther from the center line C as it extends downstream in the secondary scanning direction x. Therefore, in FIG. 2A, a transferring force F1 for transferring the ink ribbon R to the upper right is generated at each of the projections 70 positioned on the upper side of the center ling C. On the other hand, a transferring force F2 for transferring the ink ribbon R to the lower right is generated at each of the projections 70 positioned on the lower side of the center ling C.

The transferring force F1 is broken into two components F1*x* and F1*y*, whereas the transferring force F2 is broken into F2*x* and F2*y*. On the upper side of the center line C, the upward force F1*y* acts on the ink ribbon R. On the lower side of the center line C, the downward force F2*y* acts on the ink ribbon R. Thus, due to the components F1*y* and F2*y* of the primary scanning direction y of the transferring forces F1 and F2, the ink ribbon R is positively stretched in the primary scanning direction y toward the opposite sides relative to the center line C.

Therefore, the ink ribbon R is prevented from shrinking in the primary scanning direction y due to the heating by the heat-producing resistance sections 30 and the subsequent cooling by air, so that wrinkles in the primary scanning direction y are unlikely to be formed in the ink ribbon R. As a result, print failure due to such wrinkles in the ink ribbon R is reduced.

The angle of inclination of the projections 70 on the upper side of the center line C with respect to the center line C is generally equal to the angle of inclination of the projections 70 on the lower side of the center line C. Therefore, the component F1*y* of the transferring force which acts on the ink ribbon R on the upper side of the center line C is generally equal to the component F2*y* of the transferring force which acts on the ink ribbon on the lower side of the center line C, so that the two components cancel each other. Therefore, the ink ribbon R is not transferred obliquely relative to the center line C.

Figure 3:
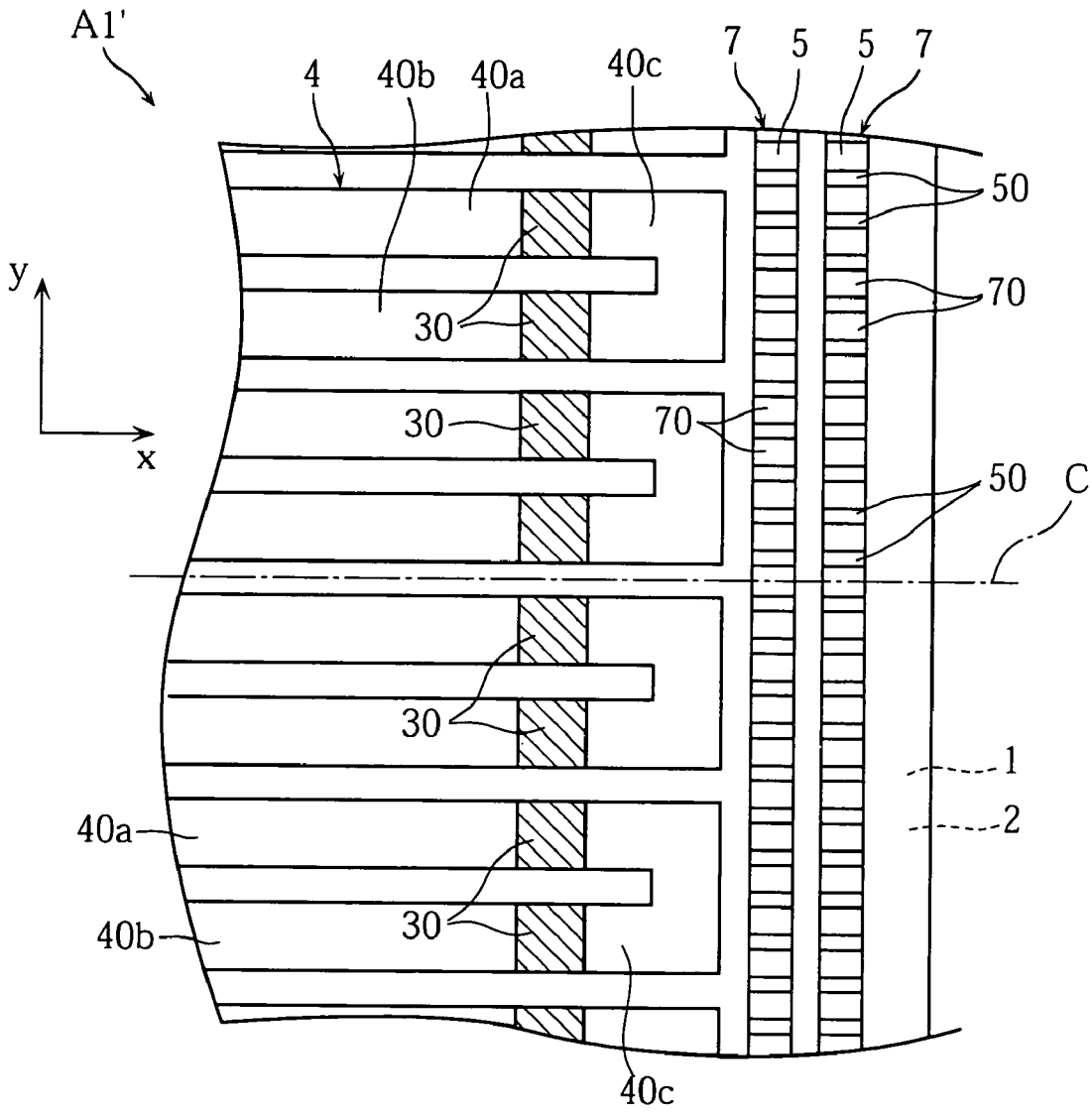
FIG. 3 is an enlarged plan view showing a principal portion of a thermal printhead according to a second embodiment of the present invention.

FIG. 3 shows a thermal printhead according to a second embodiment of the present invention. In this figure, the elements which are identical or similar to those of the first embodiment are designated by the same reference signs as those used for the first embodiment.

In the thermal printhead shown in FIG. 3, each of the grooves 50 formed at the upper portion of the edge patterns 5 extends in the secondary scanning direction x without inclination with respect to the center line C. Therefore, the angle of inclination of the projections 70 of the inequality surface region 7 with respect to the center line C is zero.

In the thermal printhead A1' according to the second embodiment, since each of the projections 70 provided on the edge patterns 5 extends in parallel with the center line C, the transferring force generated between the ink ribbon R and the inequality surface region 7 becomes generally parallel with the secondary scanning direction x. Therefore, unlike the thermal printhead A1 of the first embodiment, the upward component F1*y* of the transferring force F does not act on the ink ribbon on the upper side of the center line C, and the downward component F2*y* of the transferring force F does not act on the ink ribbon on the lower side of the center line C. Therefore, in transferring the ink ribbon R, a force to stretch the ink ribbon R in the primary scanning direction y toward the opposite sides relative to the center line C does not act on the ink ribbon R.

However, each of the projections 70 serves to guide the ink ribbon R in the primary scanning direction y, and when a force to shrink the ink ribbon R in the primary scanning direction y toward the center line C is generated in transferring the ink ribbon R, a resisting force against such a force is generated at each of the projections 70. Therefore, in the second embodiment again, the formation of wrinkles in the ink ribbon R is prevented.

As will be understood from the second embodiment and the first embodiment, the formation of wrinkles of the primary scanning direction y in the ink ribbon R is effectively prevented whether or not the projections 70 of the inequality surface region 7 are inclined with respect to the center line C. Therefore, projections 70 inclined with respect to the center line C and those which are not inclined may be mixedly provided. The angle of inclination relative to the center line C may be different among the projections.

Figure 4:
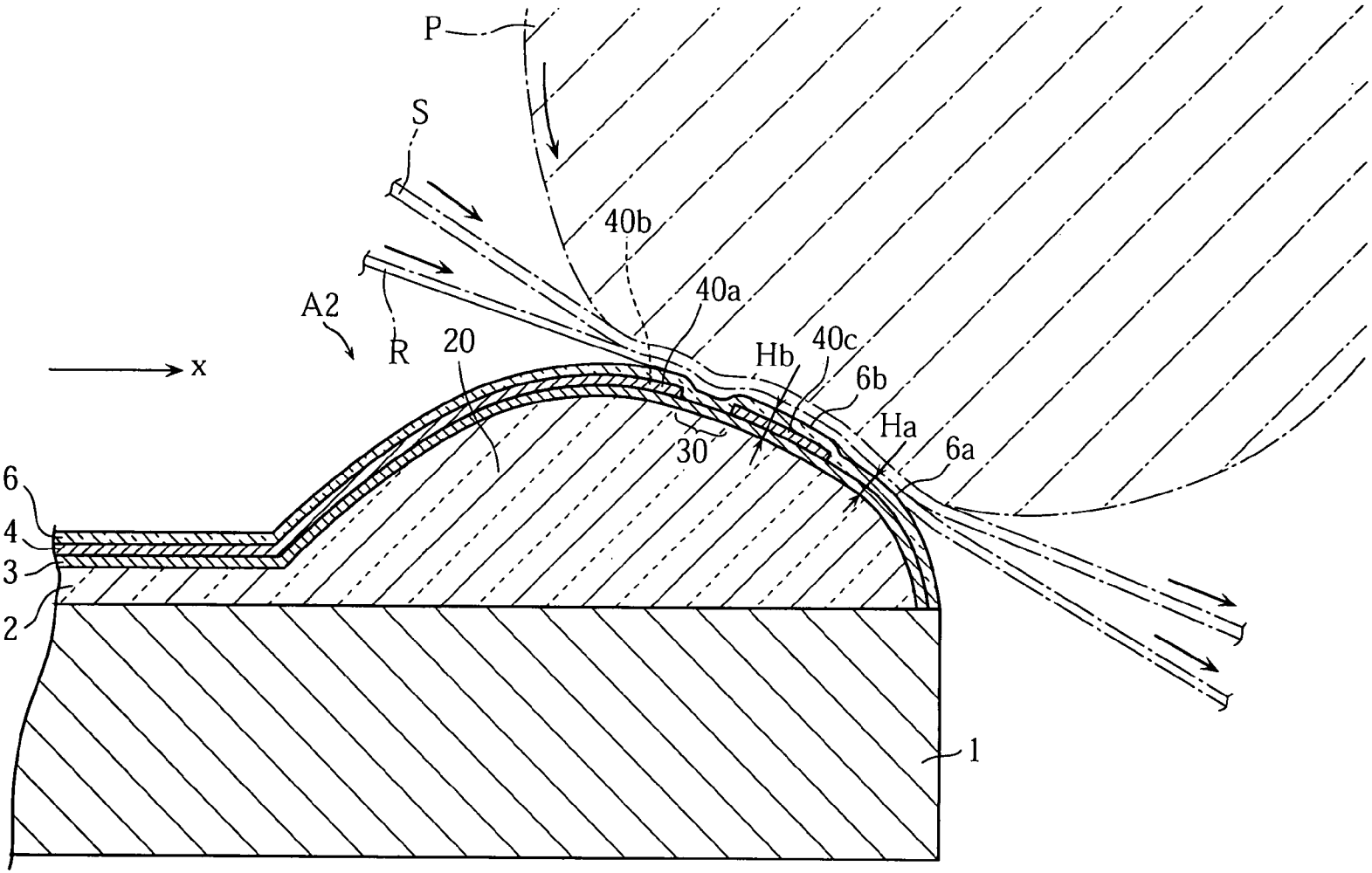
FIG. 4 is a sectional view showing the principal portion of a thermal printhead according to a third embodiment of the present invention.
Figure 5:
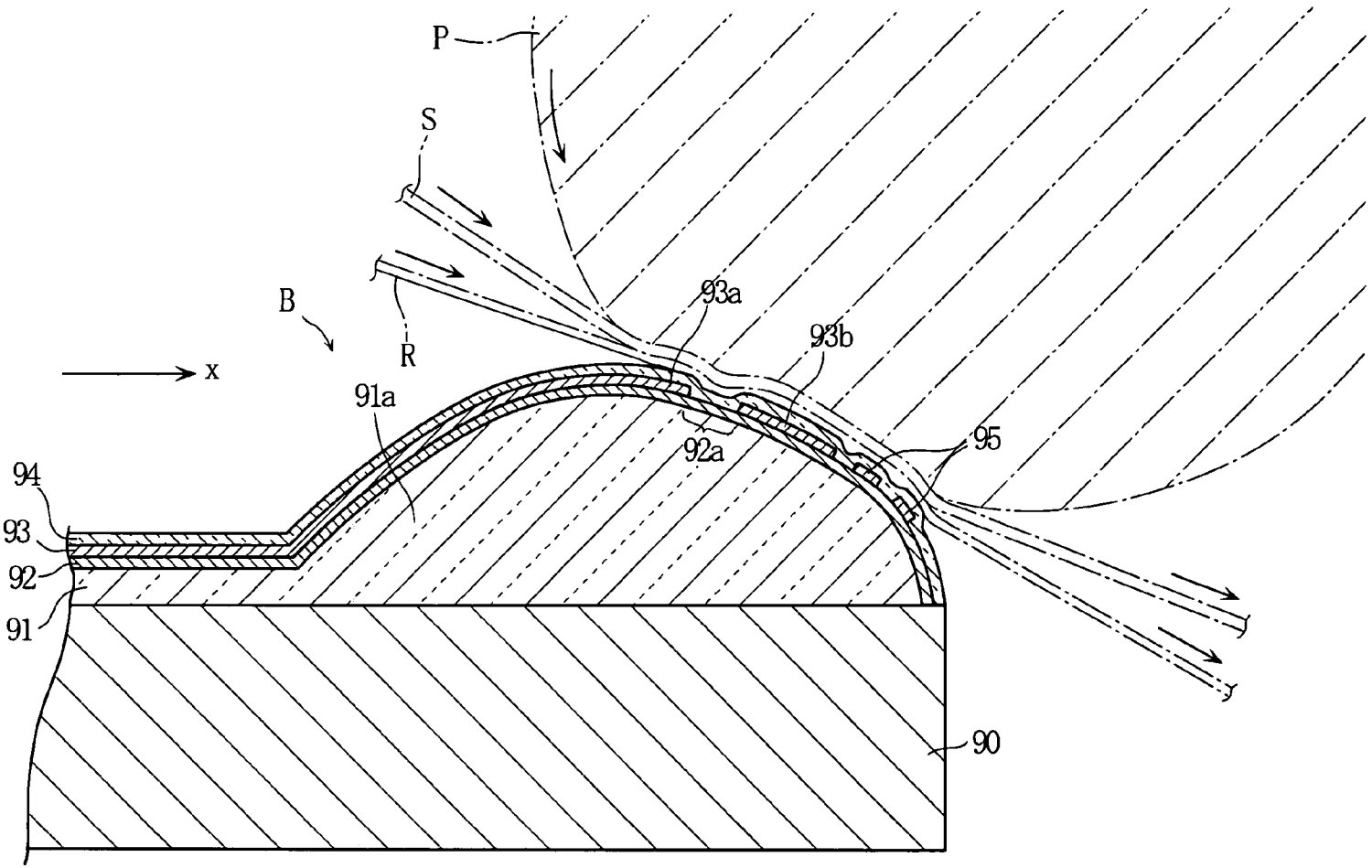
FIG. 5 RELATED ART
FIG. 5 is a sectional view showing the principal portion of a thermal printhead as related art.

FIG. 4 shows a thermal printhead according to a third embodiment of the present invention. In this figure, the elements which are identical or similar to those of the first embodiment are designated by the same reference signs as those used for the first embodiment.

The thermal printhead A2 shown in FIG. 4 does not include portions corresponding to the edge patterns 5 of the thermal printhead A1 of the first embodiment. Therefore, of the obverse surface of the protective layer 6, a downstream region 6*a*, which is positioned downstream from the third electrode portions 40*c* in the secondary scanning direction x, is entirely lower than a region 6*b* covering the third electrodes 40*c* in height on the glaze layer 2.

Specifically, the height Ha of the downstream region 6*a*, which is located downstream from the third electrode portions 40*c*, on the glaze layer 2 (which means the height normal to the upper surface of the glaze layer 2, and this holds true for the height Hb described below) is lower than the height Hb of the region 6*b*, which covers the third electrode portions 40*c*, on the glaze layer 2. The downstream region 6*a* is so inclined as to gradually reduce the height from the upper surface of the substrate 1 as it extends downstream in the secondary scanning direction x. The downstream region is a smooth obverse surface without recesses or projections.

With such a structure, when the platen roller P transfers the recording sheet S and the ink ribbon R in the secondary scanning direction x while pressing the recording sheet and the ink ribbon against the portion of the protective layer 6 which corresponds to the heat-producing resistance sections 30 and the nearby portions, the ink ribbon R is prevented from being strongly pressed against the region 6*a* of the protective layer 6 which is downstream from the third electrode portions 40*c* in the secondary scanning direction x.

Moreover, since the downstream region 6*a* of the protective layer 6 is a smooth surface without projections or recesses, the ink ribbon R is smoothly released from between the platen roller P and the thermal printhead A2 without being caught on the downstream region 6*a*. Therefore, in the thermal printhead A2 again, the formation of wrinkles in the ink ribbon R is prevented, so that the print failure due to the wrinkles in the ink ribbon R is reduced.

The present invention is not limited to the foregoing embodiments. The thermal printhead according to the present invention may be varied in many ways without departing from the spirit of the present invention.

For instance, the inequality surface region 7 on the downstream side of the third electrode portions 40*c* in the secondary scanning direction x may be formed without utilizing edge patterns 5. In a structure which does not include edge patterns 5 like the thermal printhead A2 of the third embodiment, the inequality surface region 7 may be provided by alternately forming projections and recesses at part of the protective layer 6. To reliably prevent the formation of wrinkles in the ink ribbon, it is preferable to make the area of the inequality surface region 7 as large as possible. However, the present invention is not limited thereto, and the area is not limited to be specified.

The pattern of electrodes of the thermal printhead is not limited. The present invention is also applicable to a thermal printhead which includes a common electrode with so-called comb-tooth portions. Moreover, the present invention is applicable to both of a thick-film thermal printhead and a thin-film thermal printhead.

The invention claimed is:

1. A thermal printhead comprising a substrate and a plurality of heat-producing resistance sections provided on the substrate, the heat-producing resistance sections melting ink of an ink ribbon, which is transferred together with a recording sheet, to transfer the ink onto the recording sheet;

wherein the thermal printhead further comprises an inequality surface region provided downstream from the heat-producing resistance sections in a secondary scanning direction which is a transfer direction of the ink ribbon, the inequality surface region including a plurality of projections each of which extends in the secondary scanning direction and which are aligned at predetermined intervals in a primary scanning direction which is perpendicular to the secondary scanning direction;

wherein at least some of the projections are inclined with respect to a center line so as to become farther from the center line as the projections extend downstream in the secondary scanning direction, the center line being a line positioned at the center, in the primary scanning direction, of a region where the heat-producing resistance sections are arranged.

2. The thermal printhead according to claim 1, further comprising a glaze layer formed on the substrate; and an edge pattern which is formed adjacent to a downstream edge of the glaze layer in the secondary scanning direction and is in a form of a rib extending in the primary scanning direction;

wherein the inequality surface region is provided by forming inequalities at an upper portion of the edge pattern.

3. The thermal printhead according to claim 1, wherein the projections are arranged in a plurality of rows each extending in the primary scanning direction.

4. The thermal printhead according to claim 3, wherein those of the projections arranged in one row are aligned with corresponding ones of the projections arranged in another row.

5. The thermal printhead according to claim 1, wherein those of the projections that are located on one side of the center line in the primary scanning direction are inclined in a first direction, those of the projections that are located on an opposite side of the center line in the primary scanning direction are inclined in a second direction opposite to the first direction.

* * * * *